US006553597B2

(12) United States Patent
Anderson

(10) Patent No.: US 6,553,597 B2
(45) Date of Patent: Apr. 29, 2003

(54) INGOT CLEANING APPARATUS

(76) Inventor: Edward E. Anderson, Route 4, Box 972, Salem, MO (US) 65560

( * ) Notice: Subject to any disclaimer, the term of this patent is extended or adjusted under 35 U.S.C. 154(b) by 186 days.

(21) Appl. No.: 09/793,434

(22) Filed: Feb. 27, 2001

(65) Prior Publication Data

US 2002/0116773 A1 Aug. 29, 2002

(51) Int. Cl.[7] ..... B08B 1/02; B08B 1/04

(52) U.S. Cl. ..... 15/4; 15/21.1; 15/93.1

(58) Field of Search ..... 15/3, 4, 88.2, 88.3, 15/93.1, 93.4; 83/168, 639.1, 632, 635, 644, 563, 564, 914; 425/806

(56) References Cited

U.S. PATENT DOCUMENTS 3,458,396 A * 7/1969 Grant
3,849,820 A * 11/1974 Lang
4,407,037 A * 10/1983 Kemble
4,428,090 A * 1/1984 Coggin et al.
5,587,185 A * 12/1996 Schmidgall et al.
5,600,861 A * 2/1997 Saito
5,829,087 A * 11/1998 Nahimura et al.
5,931,071 A * 8/1999 Mori
6,374,736 B1 * 4/2002 Cresgy et al.

* cited by examiner

*Primary Examiner*—Terrence R. Till
(74) *Attorney, Agent, or Firm*—Hovey Williams LLP

(57) ABSTRACT

A cleaner (10) for cleaning dross off of the surface of ingot-filled-molds (F) moving along a conveyor (C) is disclosed. The cleaner (10) includes a boom (14) pivotally mounted to a base (12), an arm (16) housed at least partially within the boom (14) and pivotally mounted thereto, a cutting blade (18) slidably mounted on the arm (16) and a rotatable brush (20) pivotally mounted to a brush arm (132). The cutting blade (18) is driven by a piston and cylinder assembly (112) pivotally coupled between the blade (18) and the arm (16). The arm (16) is pivoted by a piston and cylinder unit (120) coupled between the arm (16) and the boom (14). The brush (20) is pivoted by a piston and cylinder combination (168) coupled between the brush (20) and the brush arm (132).

33 Claims, 6 Drawing Sheets

FIG. 2.
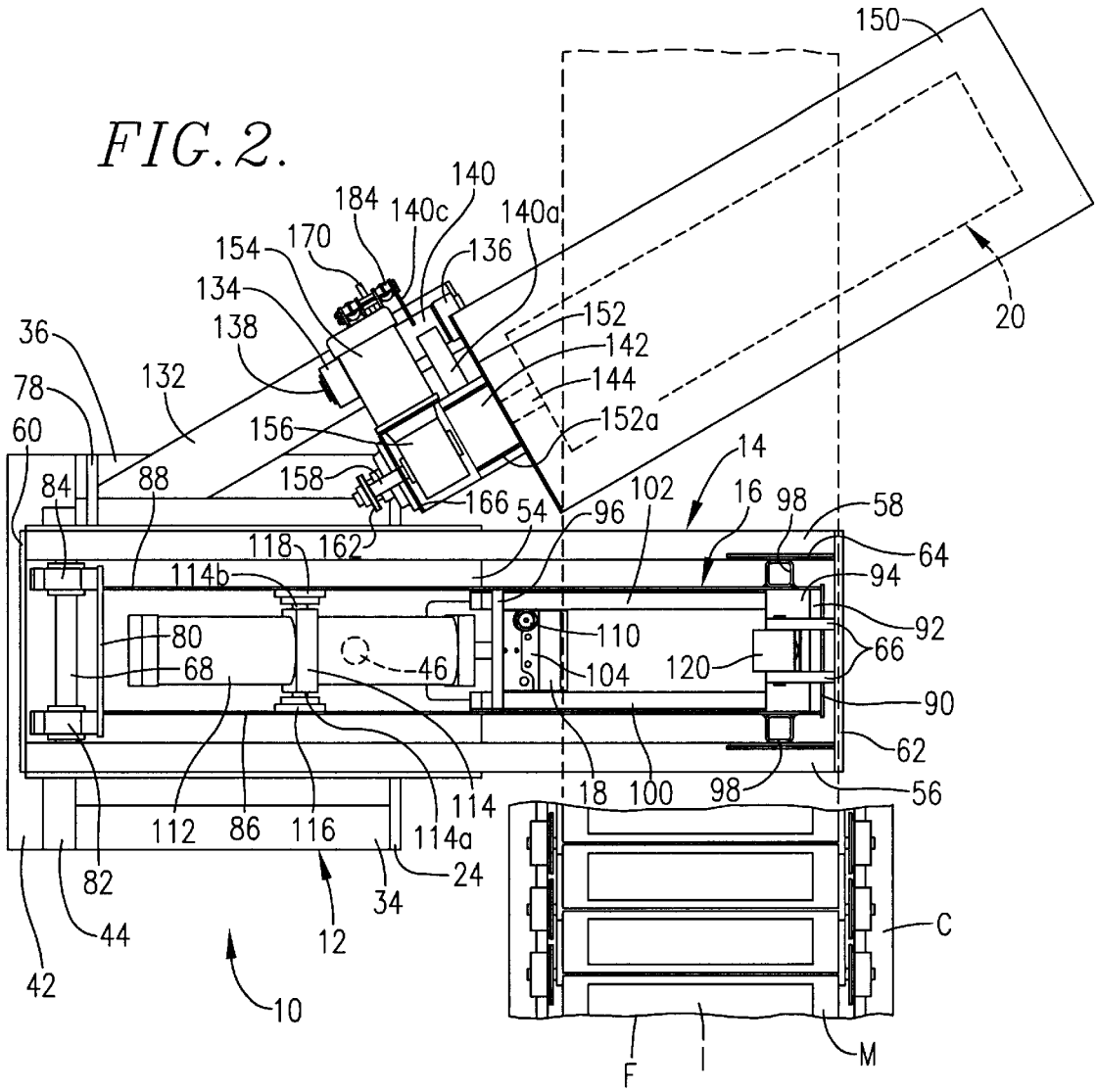
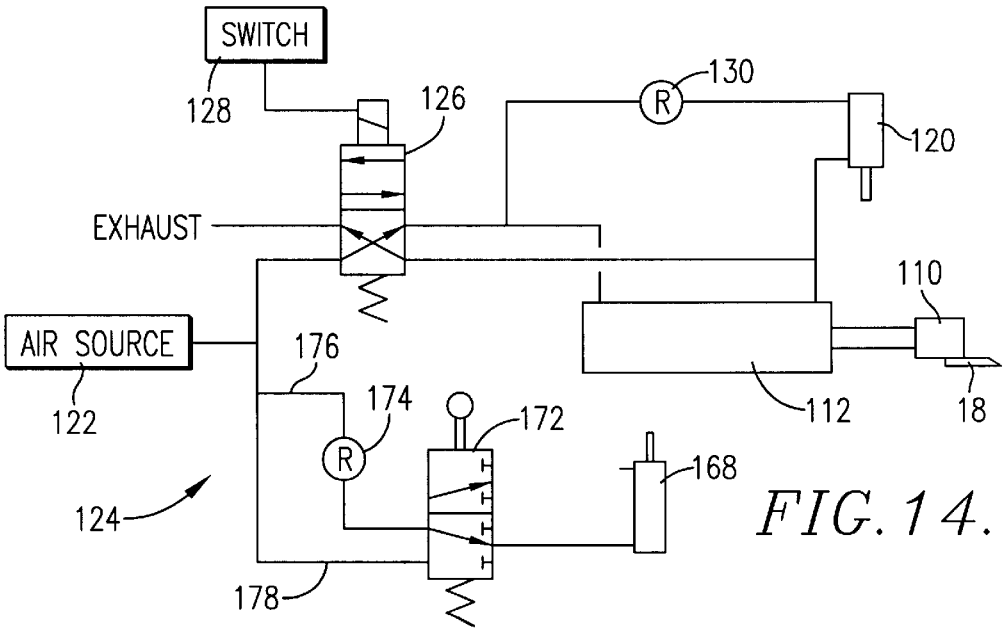
FIG. 14.

FIG. 3.
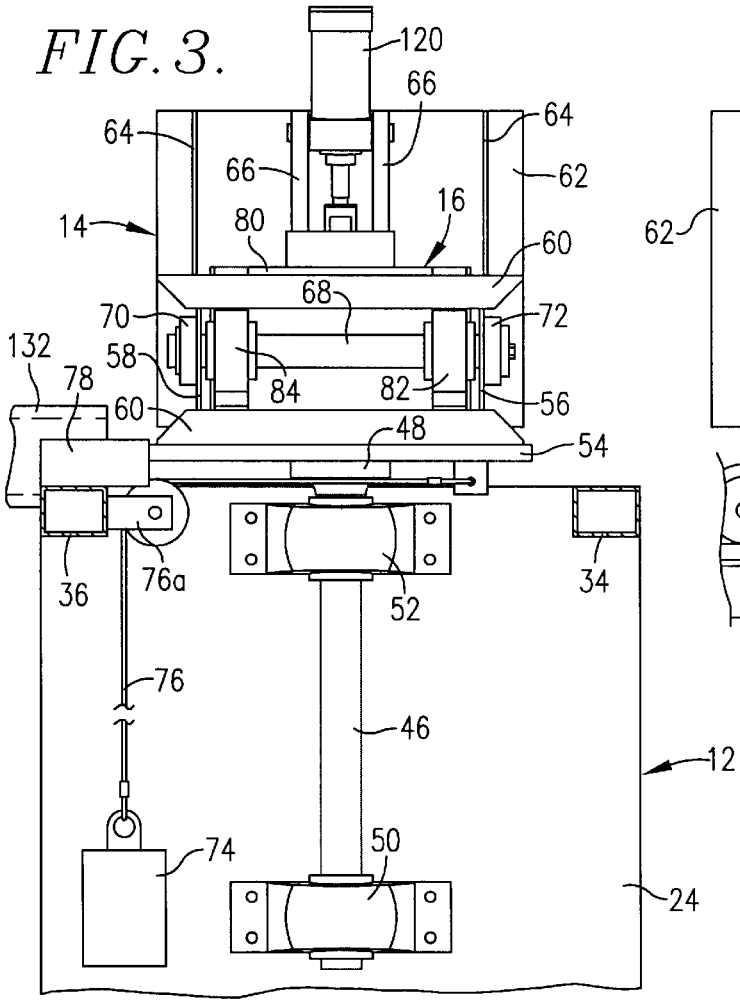
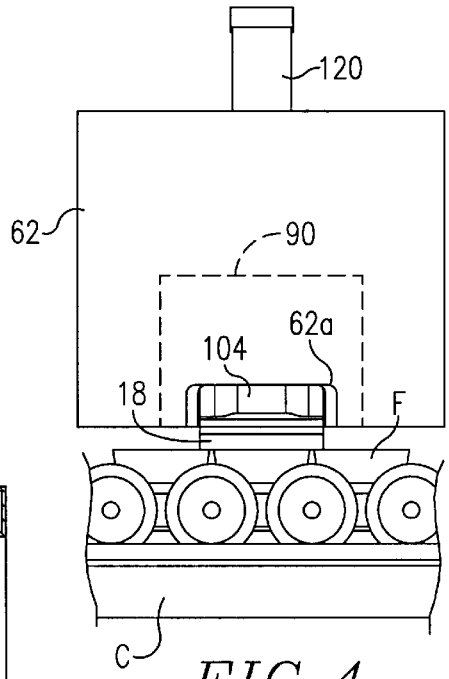
FIG. 4.
FIG. 12.
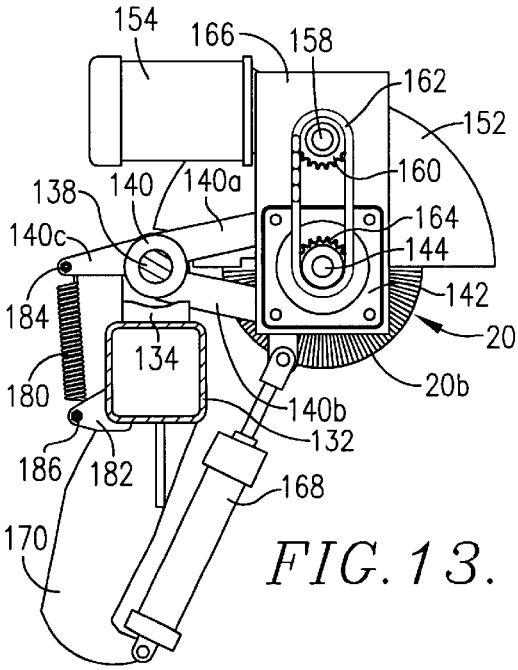
FIG. 13.
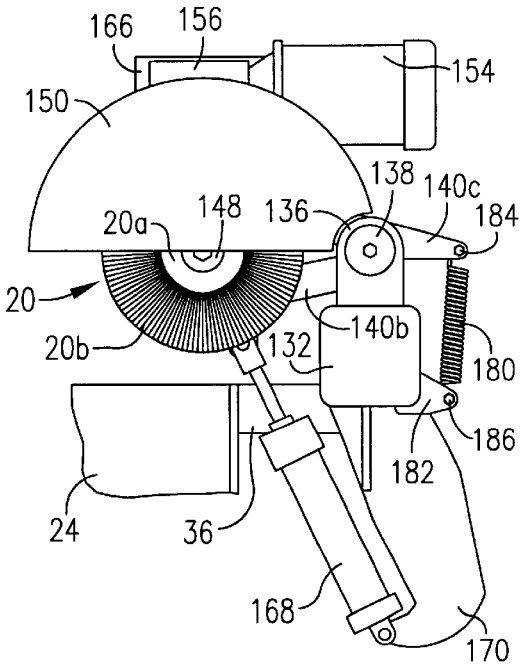

13.
13.
12
20
20a
20b
24
36
132
134
136
138
140
140a
140b
140c
142
144
146
148
150
152
152a
154
156
158
160
162
164
166
168
170
170a
180
182
184
186

INGOT CLEANING APPARATUS

BACKGROUND OF THE INVENTION

1. Field of the Invention

The present invention relates generally to equipment for cleaning the surface of an ingot in a mold. More specifically, the present invention concerns an apparatus having a trunnion mounted, bearing supported knife and a floating brush for cleaning the surface of an ingot in a mold.

2. Discussion of Prior Art

In the molding industry, materials are commonly molded into convenient shapes to facilitate their transport. For example, metals such as aluminum and lead are typically molded into stackable ingots of various standard weights (e.g., 65 and 100 lb. bars). When material is cast into an ingot in a mold, dross (e.g., bits, flashing, overfill, spillage, etc.) typically forms on the top surface of the ingot and the mold itself. It is desirable for the ingots to have a generally smooth surface—a smooth surface facilitates uniform stacking of the ingots as well as enhances the overall appearance of the material—therefore it is desirable to clean off and remove the dross.

Cleaning of the top surface of the ingot and the mold is typically performed by running a knife across the surface of the mold and in some applications may further include passing the ingot-filled-mold under a wire-type brush to further clean the surface (e.g., shavings from the knife).

Known prior art knives include cutting blades mounted on the end of, and supported by, an actuated piston and cylinder assembly. Unfortunately, these cylinder mounted blades tend to wear out quickly, frequently break and require significant maintenance, resulting in frequent downtime of the entire assembly line.

Known prior art brushes include wire-type brushes that are manually or mechanically height-adjusted to control/adjust the surface pressure of the brush on the ingot. Unfortunately, these manually or mechanically adjusted brushes often require adjustment, wear out quickly, and scratch the surface of the ingot. These problems are undesirable because they result in added expense, downtime and lower quality ingots.

SUMMARY OF THE INVENTION

The present invention provides an improved cleaner that does not suffer from the problems and limitations of prior art cleaners set forth above. The inventive cleaner provides a knife that does not transfer the shock force associated with the sudden stoppage of the knife along the ingot-filled-mold surface (e.g., hitting a bolt-head protruding from the mold surface) directly to the actuated piston and cylinder assembly. The inventive cleaner further provides a brush that does not apply excessive pressure on the ingot surface (i.e., undesirable brush-wearing or ingot-scratching pressure) and does not require frequent height adjustment.

The cleaner of the present invention broadly includes a boom pivotally mounted to a base and operable to pivot about an upright axis, an arm housed at least partially within the boom, pivotally mounted thereto, and operable to pivot about a horizontal axis, a cutting blade slidably mounted on the arm and operable to cut dross off of ingot-filled-molds, and a rotatable brush pivotally mounted to a brush arm about a horizontal axis and operable to brush dross off of the surface of ingot-filled-molds.

The cutting blade is driven by a piston and cylinder assembly coupled between the blade and the arm, pivotable about a center axis, and operable to slide the blade relative to the arm. The arm is pivoted by a piston and cylinder unit coupled between the arm and the boom and operable to pivot the arm relative to the boom.

The brush arm is rigidly fixed to the base. The brush is pivoted by a piston and cylinder combination coupled between the brush and the brush arm and operable to pivot the brush relative to the brush arm to maintain a substantially constant pressure on the surface of ingot-filled-molds.

In operation, the cylinder assembly slides the blade along the surface of an ingot-filled-mold moving along a conveyor. As it slides, the blade cuts dross off of the surface of the ingot-filled-mold. The cylinder unit then retracts, pivoting the arm, while the cylinder assembly recoils the blade. The ingot-filled-mold continues to move along the conveyor where it passes under the rotating brush. The brush brushes remaining, loosened dross off of the surface of the ingot-filled-mold.

Other aspects and advantages of the present invention will be apparent from the following detailed description of the preferred embodiment and the accompanying drawing figures.

BRIEF DESCRIPTION OF THE DRAWING FIGURES

A preferred embodiment of the invention is described in detail below with reference to the attached drawing figures, wherein:

FIG. 2 is a top plan view of the cleaner shown with the conveyor;

FIG. 3 is a fragmentary rear view of the cleaner with parts broken away, illustrating the boom shaft and the mechanism for yieldably biasing the boom;

FIG. 4 is a fragmentary front view of the knife assembly shown with the conveyor;

FIG. 12 is an end view of the brush assembly with a fragmentary part of the base;

FIG. 13 is a cross-sectional vew taken substantially along line 13—13 of FIG. 5;

FIG. 14 is a schematic diagram showing the flow of the pressurized air circuitry.

DETAILED DESCRIPTION OF THE PREFERRED EMBODIMENTS

Figure 1:
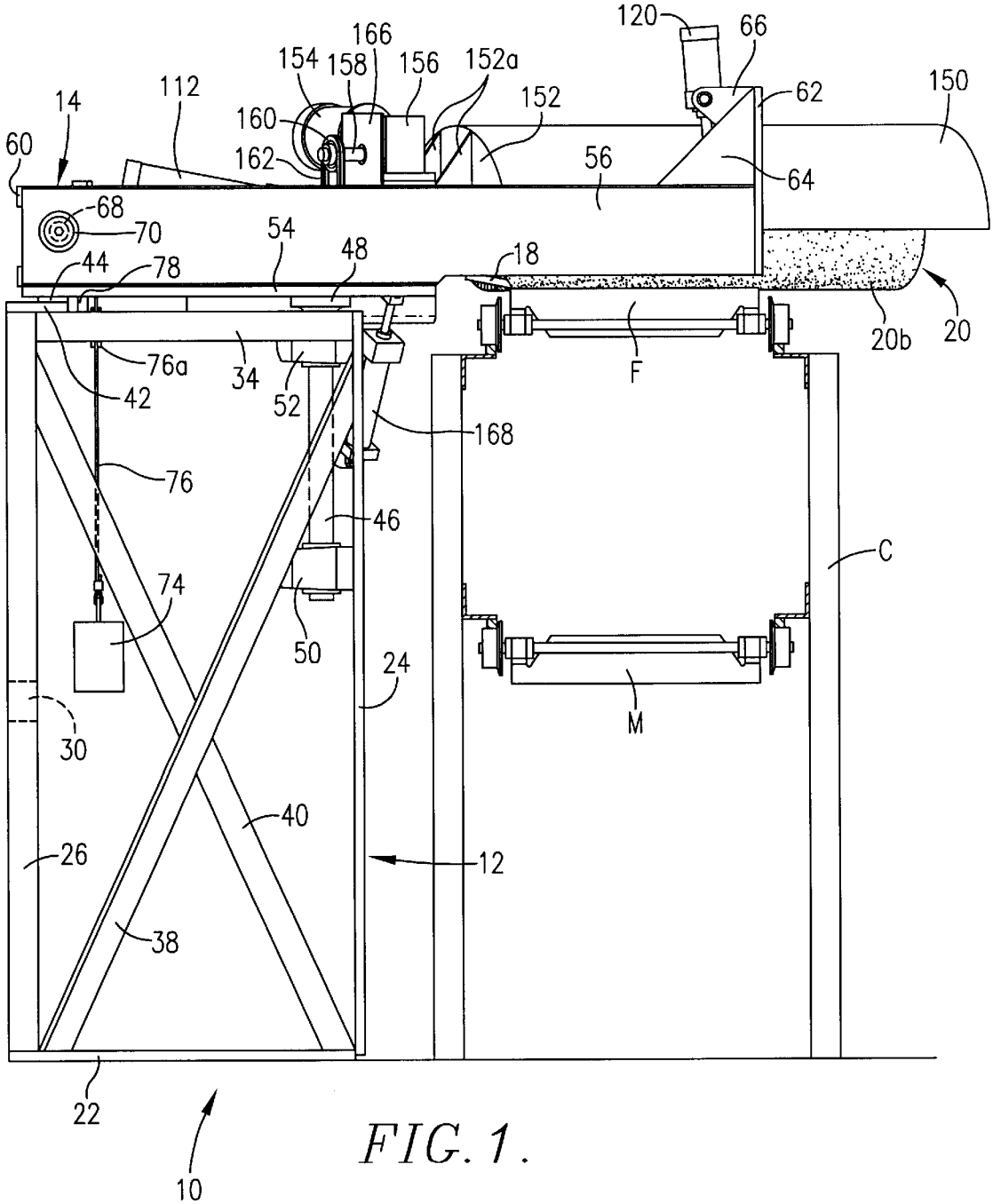
FIG. 1 is a side elevational view of a cleaner constructed in accordance with a preferred embodiment of the present invention and shown in combination with a conveyor carrying ingot-filled-molds.

FIG. 1 illustrates a cleaner 10 constructed in accordance with a preferred embodiment of the present invention and configured for cleaning dross off of the surface of ingot-filled-molds F—including an ingot I (see FIG. 2) in a mold M—moving along a conveyor C. The cleaner 10 broadly includes a base 12, a boom 14 pivotally mounted to the base 12, an arm 16 pivotally mounted to the boom 14, a cutting blade 18 slidably mounted on the arm 16, and a rotatable brush 20 mounted to the base 12. The preferred cleaner 10 also includes pneumatically driven piston and cylinder apparatus described below for controllably pivoting the arm 16, sliding the blade 18, and pivoting the brush 20.

In more detail, the base 12 includes a base plate 22 configured for attachment to a floor or other horizontal surface. Rigidly fixed to the base plate 22 and upwardly extending therefrom, is a substantially flat, solid wall 24 and a tubular framework including a pair of upwardly extending vertical members 26,28, a pair of horizontal members 30,32 fixed between the vertical members 26,28, and a pair of lateral members 34,36 extending between the vertical members 26,28 and the wall 24 and fixed thereto. Further supporting the base 12 are two pair of diagonal braces, with only the pair 38,40 being shown. The horizontal member 32, the upper ends of the vertical members 26,28 and the ends of the lateral members 34,36 opposite the wall 24 are further joined by a top brace 42. The above described components of the base 12 are preferably formed of a hard, high strength metal (e.g., steel).

As shown in FIGS. 1 and 2, a nylon pad 44 is secured to the top surface of the top brace 42 for purposes that will subsequently be described. As shown in FIG. 3, an upright boom shaft 46, having an integrally formed flange 48 at its upper end, is rotatably supported on the wall 24 by a pair of pillow block bearings 50,52. The boom 14 is pivotally supported on the base 12 by the boom shaft 46. In particular, the flange 48 of the shaft 46 is fixed to a bottom support plate 54 of the boom 14. The boom 14 is generally rectangular in shape and includes a pair of substantially parallel, channeled side walls 56,58. Each of the side walls 56,58 are rigidly fixed to the bottom plate 54. The side walls 56,58 are further adjoined at their proximal ends (adjacent the base 12) by a pair of end slats 60. The side walls 56,58 are adjoined at their distal ends (opposite the base 12) by an end plate 62 having a portion thereof that extends upwardly beyond the side walls 56,58. The end plate 62 is gusseted to the side walls 56,58 by a pair of gussets 64 fixed to the upwardly extending portion of the end plate 62 and the flanged portion of the channeled side walls 56,58. As will subsequently be described, the end plate 62 has a notch 62*a* cut in the bottom portion of the end plate 62 (opposite the upwardly extending portion). Attached to the inside surface of the upwardly extending portion of the end plate 62 are a pair of cylinder supporting lugs 66 for purposes that will subsequently be described.

The boom 14 is configured to provide an open distal portion defined between the side walls 56,58, the end plate 62 and the bottom plate 54. Opposite the open distal portion of the boom 14 (adjacent the end slats 60) is an arm shaft 68 rigidly supported on the side walls 56,58. The shaft 68 is fixed to the side walls 56,58 by boss assemblies 70,72. The assemblies 70,72 also function to prevent the shaft 68 from shearing the side walls 56,58. A journal lock mechanism (not shown) is fixed to the assembly 72 and the shaft 68 to prevent undesirable rotation of the shaft 68.

The boom 14 is pivotable between an operating position, shown in FIG. 2, and a mold-clearing position (not shown). In the operating position, the boom 14 is substantially transverse to the conveyor C. In the mold-clearing position, the distal end of the boom 14 has traveled along the conveyor C in the direction of conveyor movement. The conveyor C moves from left to right (when viewed from the front as in FIG. 4); therefore, in the illustrated embodiment, the boom 14 pivots on the boom shaft 46 relative to the base 12 in a counterclockwise direction (when viewed from above as in FIG. 2). The boom 14 preferably includes a mechanism to yieldably bias the boom 14 toward the operating position. In the illustrated cleaner 10 this mechanism includes a weight 74, hooked to a cable assembly including a cable 76 and a pulley assembly 76*a* (see FIG. 3). The cable 76 is hooked to the bottom surface of the plate 54 of the boom 14. The cable 76 entrains the pulley assembly 76*a* attached to the inner face of the lateral member 36 of the base 12. The boom 14 is prevented from pivoting past the operating position by a stop 78 fixed to the base 12. It is well within the ambit of the present invention to utilize various alternative biasing mechanisms, for example, a spring operated mechanism.

Turning to FIG. 2, the blade arm 16 is pivotally supported on the boom 14 by the arm shaft 68. In particular the arm 16 includes a bearing support plate 80 at its proximal end. A pair of pillow block bearings 82,84 are rotatably coupled to the arm shaft 68 and are fixed to the outside face of the support plate 80. Extending laterally from the inside face of the support plate 80 are a pair of substantially flat, parallel arm walls 86,88. The arm walls 86,88 are adjoined at their distal ends by an arm end plate 90 and an arm end slat 92 fixed thereto. Fixed to the arm end slat 92 is a lift cylinder mount 94, for purposes that will subsequently be described. The arm end plate 90 has a notch 90*a* at its lower edge, similar to the notch 62*a* in the boom end plate 62, for reasons that will become apparent. The arm walls 86,88 are further adjoined by a cylinder plate 96 having a notch 96*a*. The cylinder plate 96 is positioned between the support plate 80 and the end plate 90 and dividing the arm 16 into a cylinder housing section at its proximal end and a blade supporting section at its distal end. The arm 16 is configured to be housed at least partially within the boom 14. The arm 16 pivots on the arm shaft 68 relative to the boom 14. In this regard, the arm 16 includes a pair of tubular arm guides 98 attached to the outside surfaces of the arm walls 86,88, respectively, at their distal ends. The arm guides 98 are configured to maintain the spacing between the arm 16 and the boom 14 to provide substantially unobstructed and uniform pivotal movement of the arm 16 relative to the boom 14 (e.g., as the boom 14 pivots from the operating position to the mold-clearing position).

Figures 5, 6:
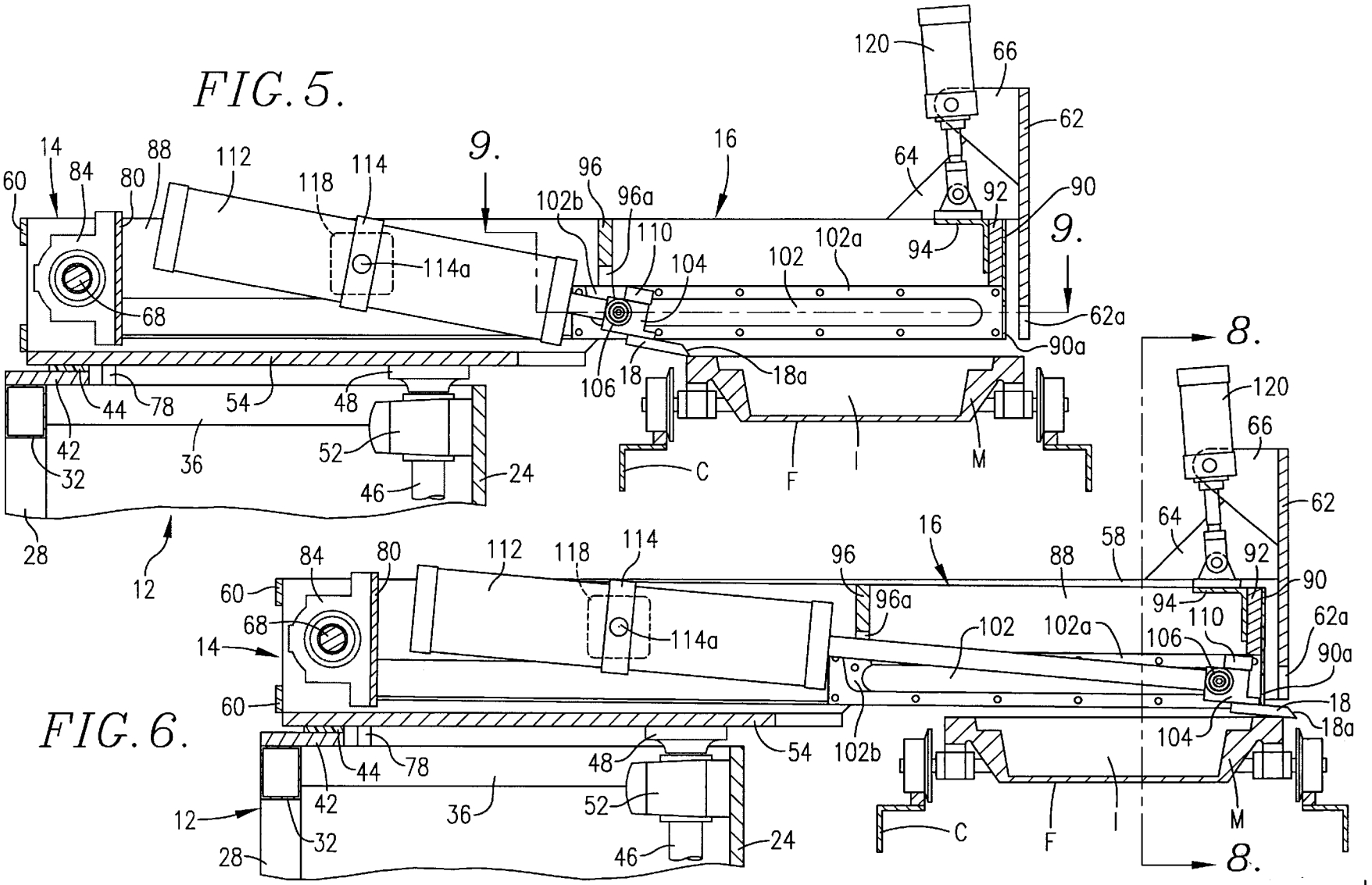
FIG. 5 is a longitudinal vertical sectional view of the knife assembly shown with the conveyor, illustrating the blade in the before-cut position.
FIG. 6 is a longitudinal vertical sectional view of the knife assembly shown with the conveyor, illustrating the blade in the after-cut position.
Figures 7, 8, 9:
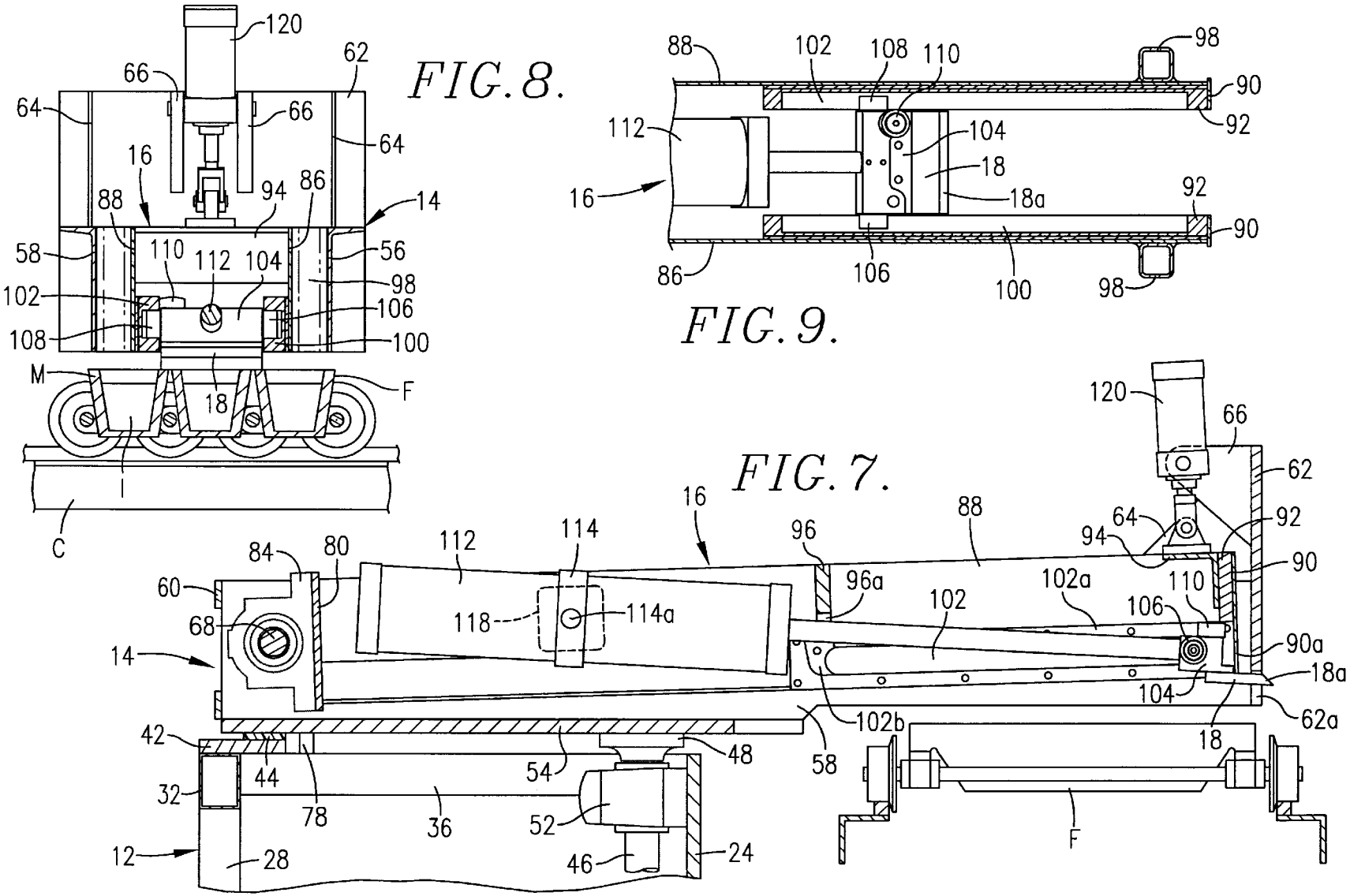
FIG. 7 is a longitudinal vertical sectional view of the knife assembly shown with the conveyor, illustrating the arm in the recoil position.
FIG. 8 is a cross-sectional view taken substantially along line 8—8 of FIG. 6.
FIG. 9 is a cross-sectional view taken substantially along line 9—9 of FIG. 5.

The arm 16 pivots between a cutting position, as shown in FIGS. 5 and 6, and a recoil position, as shown in FIG. 7. In the cutting position, the arm 16 at least partially protrudes out of the bottom of the open distal portion of the boom 14 and in the recoil position, the arm 16 has pivoted upwardly from the cutting position so that the arm 16 is substantially housed within the boom 14.

The arm 16 further includes a pair of bearing-receiving tracks 100,102. The tracks 100,102 are fixed to the bottom portion of the inside surface of the arm walls 86,88, respectively. The tracks 100,102 extend along the blade supporting section of the arm walls 86,88 between the cylinder plate 96 to the inside edge of the arm end plate 90, and are fixed to the bottom edge of the arm end slat 92 (see FIGS. 5 and 6). The tracks 100,102 are configured to receive bearing wheels. The tracks 100,102 further include a substantially smooth inside edge 100*a*,102*a*, respectively, for cooperation with a horizontal bearing. Each of the tracks 100,102 includes a plug (only plug 102*b* being shown) at its proximal end, configured so that when the plugs are removed the bearings (as will be subsequently described) captured within the tracks 100,102 can be removed (e.g., for maintenance, repair, replacement, etc.).

The cutting blade 18 is slidably supported on the arm 16, preferably by a blade assembly 104. The blade assembly 104 is configured to be slidably received between the tracks 100,102 of the arm 16. The assembly 104 includes vertical bearing wheels 106,108 rotatably supported on the respective sides of the assembly 104 adjacent the respective tracks 100,102 (see FIGS. 8 and 9). The bearing wheels 106,108 are slidably received within the tracks 100,102, respectively, and captured therein. The assembly 104 further includes a horizontal bearing wheel 110 rotatably supported on the top surface of the assembly 104 adjacent the inside edge 102*a* of the track 102. The bearing wheel 110 slidably cooperates with the smooth edge 102*a* to transfer certain forces effected by the moving conveyor C on the blade 18 into pivotal movement of the boom 14.

The cutting blade 18 includes a pitched cutting edge 18*a*. The blade 18 is mounted on the assembly 104 so that the cutting edge 18*a* is oriented away from the base 12. The blade 18 and the assembly 104 cooperate to provide an acute angular position of the top surface of the blade 18 relative to the bottom surface of the tracks 100,102 (see FIG. 5). The blade 18 cuts dross (e.g., bits, flashing, overfill, spillage, etc.) off of the surface of ingot-filled-molds F, including off of the surface of the ingots I and molds M. The blade 18 is preferably formed of a hardened metal (e.g., tempered steel).

The blade assembly 104 (and thus the attached blade 18) is slidable along the tracks 100,102 between a before-cut position, as shown in FIG. 5, and an after-cut position, as shown in FIG. 6. In the before-cut position, the blade 18 is adjacent the proximal end of an ingot-filled-mold F. In the after-cut position, the blade 18 is adjacent the distal end of the ingot-filled-mold F.

The cleaner 10 preferably includes a power actuator mechanism for sliding the blade 18 relative to the arm 16. In the illustrated cleaner 10, a pneumatic piston and cylinder assembly 112—the stroke cylinder—is connected between the blade assembly 104 and the arm 16 for sliding the blade assembly 104 and the attached blade 18 along the tracks 100,102. The cylinder end of the stroke cylinder 112 is pivotally mounted to the arm 16 and housed within the cylinder housing section of the arm 16. A stub shaft block 114 is fixed to the outer surface of the cylinder 112 along the center axis of the cylinder end of the stroke cylinder 112 (see FIG. 2). The block 114 is positioned transverse to the cylinder 112. The block 114 includes opposing stub shaft sections 114*a*,114*b* extending from the center of each side of the block 114. The stub shafts 114*a*,114*b* rotatably seat in the flange bearings 116,118, respectively, fixed to the inside surface of the arm walls 86,88, respectively.

The rod end of the stroke cylinder 112 is fixed to the back end of the blade assembly 104 (opposite the cutting edge 18*a* of the blade 18). The stroke cylinder 112 is oriented at a angle downward (from cylinder end to rod end) relative to the arm 16. When the stroke cylinder 112 is fully retracted, the blade 18 is in the before-cut position, as shown in FIG. 5. As the stroke cylinder 112 extends, the blade assembly and the attached blade 18 slides along the tracks 100,102 toward the after-cut position. Once the stroke cylinder 112 is fully extended, the blade 18 is in the after-cut position, as shown in FIG. 6. As the blade 18 slides from the before-cut position to the after-cut position, the stroke cylinder 112 pivots about stub shafts 114*a*,114*b* in a counterclockwise direction (when viewed from the side as in FIG. 5). Unlike prior art knives, the stroke cylinder 112 pivots about a center axis. This center axis configuration cooperates with the vertical bearing wheels 106,108 to provide optimal support for the blade 18 thereby reducing bending and breaking of the cylinder shaft. It is within the ambit of the present invention to utilize various alternative power actuator mechanisms to slide the blade 18 relative to the arm 16.

The cleaner 10 preferably also includes a power actuator mechanism for pivoting the arm 16 relative to the boom 14. In the illustrated cleaner 10, a pneumatic piston and cylinder unit 120—the lift cylinder—is connected between the arm 16 and the boom 14 for pivoting the arm 16 relative to the boom 14. In particular, the cylinder end of the lift cylinder 120 is fixed between the lugs 66 on the end plate 62 of the boom 14. The rod end of the lift cylinder 120 is fixed to the top surface of the lift cylinder mount 94 of the arm 16. When the lift cylinder 120 is substantially extended, the arm 16 is in the cutting position, as shown in FIGS. 5 and 6. As the lift cylinder 120 retracts, the arm 16 is caused to pivot around arm shaft 68 toward the recoil position. Once the lift cylinder 120 is fully retracted, the arm 16 is in the recoil position, as shown in FIG. 7. For purposes that will subsequently be described, the lift cylinder 120 is not fully extended when the arm 16 is in the cutting position. It will be appreciated that as the blade 18 slides from the before-cut position toward the after-cut position and the stroke cylinder 112 pivots, the lift cylinder 120 further extends to maintain the arm 16 in the cutting position (see FIGS. 5 and 6). It is within the ambit of the present invention to utilize various alternative power actuator mechanisms to pivot the arm 16 relative to the boom 14.

As shown in FIG. 14, the pneumatic stroke cylinder 112 and the pneumatic lift cylinder 120 are connected to a common source of pressurized air 122 (e.g., 125 psi). The cleaner 10 is preferably designed to sequence operation of the stroke cylinder 112 with the lift cylinder 120 so that the arm 16 is in the cutting position substantially at the same time (including just before or just after) the blade 18 begins to slide from the before-cut position toward the after-cut position, and the arm 16 is in the recoil position substantially at the same time (including just before and just after) the blade 18 begins to slide from the after-cut position toward the before-cut position. Such operation is provided by a circuit 124 that includes a solenoid valve 126 and an air muffler (not shown).

A limit switch 128 communicates with the conveyor C to sense the presence of a mold M approaching the cleaner 10. In the illustrated cleaner 10, the limit switch 128 is a magnetic proximity sensor mounted on one of the drive sprockets (not shown) of the conveyor C and communicating therewith; however, various suitable sensors could be utilized (e.g., various Hall-effect sensors). The presence of the mold M activates the limit switch 128 which communicates with the solenoid valve 126 to energize the circuit. The valve 126, when energized, directs the flow of pressurized air from the source 122 to the cylinder ends of the cylinders 112,120. The cylinders 112,120 begin to pressurize causing the cylinders 112,120 to extend. As the cylinders 112,120 pressurize, air in the rod end of the cylinders 112,120 is directed through the valve 126 to the air muffler. The lift cylinder 120 has a smaller volume than the stroke cylinder 112 and therefore substantially extends before the stroke cylinder 112 is sufficiently pressurized to substantially extend. When the lift cylinder 120 is substantially extended, the arm 16 is in the cutting position as shown in FIG. 5 and the cutting edge 18*a* of the blade 18 contacts the surface of the ingot-filled-mold F. As previously discussed, when the arm 16 is in the cutting position, the lift cylinder 120 is not fully extended; however, the contact of the cutting edge 18*a* of the blade 18 with the surface of the ingot-filled-mold F prevents the cylinder 120 from fully extending. In this manner, the cylinder 120 provides a downwardly directed vertical force to the blade 18 acting on the surface of the ingot-filled-mold F. As will be subsequently described, this vertical force is selectively variable.

The stroke cylinder 112 sufficiently pressurizes and begins to extend at substantially the same time the arm 16 pivots into the cutting position. The blade 18 may move slightly before the arm 16 has reached the cutting position. As the stroke cylinder 112 extends, it slides the blade assembly 104 along the tracks 100,102. The blade 18 slides, in cooperation with the assembly 104, toward the after-cut position. When the stroke cylinder 112 is fully extended, the blade 18 is in the after-cut position, corresponding to one-half of the cycle of the circuit 124. This half cycle time substantially corresponds with the time it takes the limit switch 128 to move along the sprocket on the conveyor C between the activating and deactivating sensor so that the limit switch 128 deactivates, thereby communicating with the solenoid valve 126 to de-energize the circuit 124.

When the circuit 124 de-energizes, the solenoid valve 126 directs pressurized air from the source 122 to the rod ends of the cylinders 112,120. The cylinders 112,120 begin to depressurize causing the cylinders 112,120 to retract. As the cylinders 112,120 depressurize, air in the cylinder ends of the cylinders 112,120 is directed through the valve 126 to the air muffler. The lift cylinder 120 has a smaller volume than the stroke cylinder 112 and therefore fully retracts before the stroke cylinder 112 is sufficiently depressurized to substantially retract. When the lift cylinder 120 is fully retracted, the arm 16 is in the recoil position as shown in FIG. 7 and the cutting edge 18*a* of the blade 18 is above, and does not contact the surface of the ingot-filled-mold F.

The stroke cylinder 112 sufficiently depressurizes and begins to retract at substantially the same time the arm 16 pivots into the recoil position. The blade 18 may move slightly before the arm 16 has reached the recoil position. As the stroke cylinder 112 retracts, it slides the blade assembly 104 back along the tracks 100,102. The blade 18 slides, in cooperation with the assembly 104, toward the before-cut position. When the stroke cylinder 112 is fully retracted, the blade 18 is in the before-cut position, corresponding to a full cycle of the circuit 124. The arm 16 is in the recoil position and the blade 18 is in the before-cut position. The circuit remains in this position until the limit switch 128 reactivates the circuit 124 reinitiating the cycle.

The circuit 124 selectively controls pressure to the lift cylinder 120 when the arm 16 is in the cutting position between a down-pressure and a float-pressure. The circuit 124 includes a blade regulator 130 connected between, and communicating with, the lift cylinder 120 and the solenoid valve 126. The regulator 130 is selectively adjustable and can regulate the pressure of air flowing from the solenoid valve 126 to the lift cylinder 120. In the illustrated cleaner 10, the regulator 130 can reduce the pressure of the air flowing from the source up to 60 psi (although various alternative regulators could be utilized). When the float-pressure is desired, the regulator 130 is preset to substantially reduce the pressure of air flowing between the valve 126 and the lift cylinder 120 (e.g., from 125 psi down to 65 psi). The down-pressure effects a greater vertical force on the blade 18, relative to the float-pressure, as the blade 18 slides from the before-cut position toward the after-cut position. When the down-pressure is desired, the regulator 130 is preset to either partially reduce or not reduce the pressure of air flowing between the valve 126 and the lift cylinder 120. Both the float-pressure and the down-pressure are variable and can be preset according to the desired effect for a particular application.

It is well within the ambit of the present invention to utilize various alternative circuit designs, circuit controllers, and sources of pressure. For example, the sliding of the blade 18 and the pivoting of the arm 16 could be controlled by hydraulic piston and cylinder assemblies. In addition, the operation of the circuit could be controlled by a programmable logic controller rather than a limit switch.

Figures 10, 11:
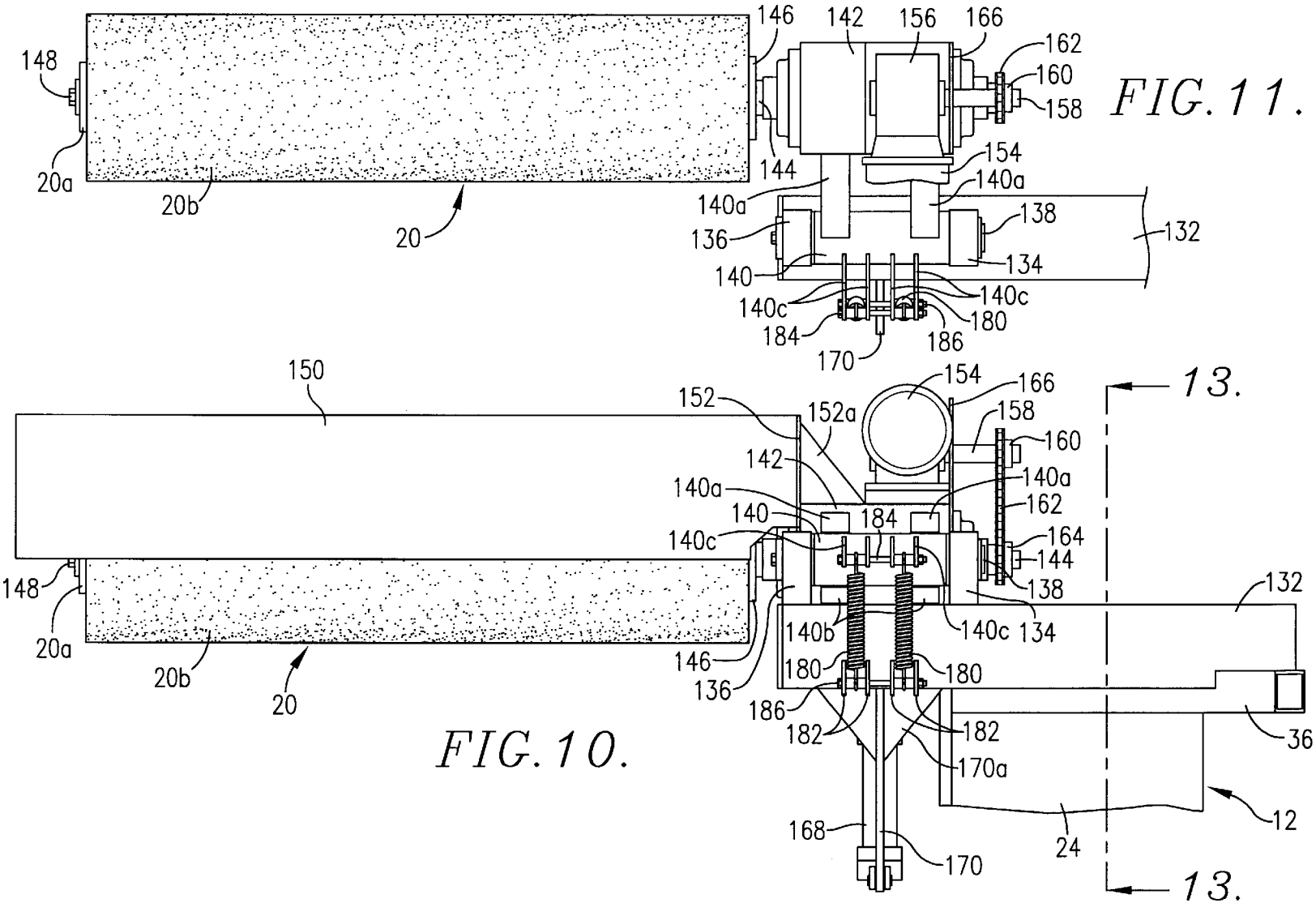
FIG. 10 is a side elevational view of the brush assembly with a fragmentary part of the base.
FIG. 11 is a plan view of the brush assembly without the brush guard.

Turning to FIG. 2, the rotatable brush 20 is pivotally supported on the base 12. In particular, a brush arm 132 is rigidly fixed to the lateral member 36 of the base 12 and extends outwardly therefrom at an angle. For purposes that will subsequently be described, the brush arm 132 preferably forms a thirty degree angle with the lateral member 36. As perhaps best illustrated in FIGS. 10 and 11, fixed to the top surface of the arm 132 at its distal end are a pair of shaft supports 134,136. Supported on the supports 134,136 is a brush shaft 138, which is prevented from rotating by a journal lock mechanism (not shown) fixed to the support 134. Pivotally supported on the brush shaft 138 is a pivotal brush support 140 having a bushing (not shown). The support 140 includes a pair of upper tubular support members 140*a* and a pair of lower tubular support members 140*b*. The upper members 140*a* extend outwardly from the brush side of the support 140 and the lower members 140*b* extend angularly therefrom (see FIG. 13). On the opposing side of the brush support 140 are triangular support members 140*c* outwardly extending opposite the tubular members 140*a* (see FIGS. 11 and 13). The tubular support members 140*a*, 140*b* are fixed to a bushing box 142.

Rotatably supported by a bushing (not shown) housed within the bushing box 142 is a mandrel 144. The proximal end of the mandrel 144 extends out of the base side of the bushing box 142. The mandrel is configured to receive (e.g., pressure fit) a pair of end caps 146,148. The end cap 146 is positioned on the mandrel 144 adjacent the brush side of the bushing box 142. The distal end of the mandrel 144 extends into the brush 20. In particular, the brush 20 includes a spool 20*a* configured to receive the distal end of the mandrel 144. The end cap 148 is fixed to the distal end of the mandrel 144 and cooperates therewith to secure the spool 20*a* in position.

The brush 20 is a wire-type brush having wirework 20*b* attached around the spool 20*a*. The brush 20 brushes dross (e.g., bits, flashing, overfill, shavings, spillage, etc.) off of the surface of ingot-filled-molds F, including off of the surface of the ingots I and molds M. The brush 20 is particularly effective at brushing dross that has been loosened from the surface of the ingot-filled-molds F (e.g., dross that has been previously cut by a blade). The brush 20 also polishes the surface of the ingot I, as is aesthetically desirable. In these regards, the illustrated cleaner 10 is designed to operate adjacent the conveyor C (as shown in FIGS. 1 and 2) so that the ingots I in the molds M pass under the blade 18 before they pass under the brush 20. The brush 20 rotates in a direction opposite the direction of movement of the conveyor C—i.e., a clockwise direction when viewed from the distal end of the brush 20 (as in FIG. 12) where the conveyor C moves in a left-to-right direction when viewed as in FIG. 4. For safety purposes, a brush guard 150 shrouds the top of the brush 20. At its proximal end, the guard 150 is fixed to a brush end plate 152 which is gusseted to the brush side of the bushing box 142 by gussets 152*a*.

The rotatable brush 20 preferably operates at thirty degree angle relative to an axis perpendicular to the direction of movement of the conveyor C. The illustrated cleaner 10 is designed to set adjacent the conveyor C and perpendicular to the direction of movement (see FIGS. 1 and 2), thus the brush arm 132 forms a thirty degree angle with the lateral member 36. The thirty degree angle provides for the optimal "walking" of the dross off of the surface of the ingot-filled-molds F. As the ingots I in the molds M move along the conveyor C under the rotating brush 20, the loosened dross will collect against the bottom edge of the wirework 20*b* of the brush 20 and travel along the brush generally parallel to the spool 20*a*. The distal end of the brush 20 at least partially extends beyond the distal end of the ingot-filled-molds F. The dross can be "walked" off of the ingot-filled-molds F over the side of the conveyor C and collected in a collection bin (not shown).

It is within the ambit of the present invention to utilize various alternative brush designs. For example, the designs could include angles other than thirty degrees; however, it is important that the relevant angle be acute in order to accomplish the desired brushing function. In addition, alternative designs could utilize a stand-alone brush—i.e., a brush not fixed to a base common with a blade—and be configured to be positioned across the conveyor from a blade, or could be fixed to a machine downline of a blade. The brush 20 is a four foot, commercially available brush; however, alternative brushes of various dimensions could be utilized.

Turning to FIGS. 12 and 13, the brush 20 is rotatably driven by a variable speed electric motor 154 cooperating with a gear box 156. The motor 154 and gear box 156 are mounted on the top surface of the bushing box 142 and thus pivot in sync with the brush 20. The motor 154, through the gear box 156, drives one end of an output shaft 158 having a drive sprocket 160 fixed on the opposing end. A chain 162 entrains the drive sprocket 160 and extends downwardly therefrom to entrain a driven sprocket 164. The driven sprocket 164 is fixed to the proximal end of the mandrel 144. The sprockets 160,164 and the chain 162 are housed within a chain guard (not shown) attached to the bushing box 142 by a guard mount plate 166.

The cleaner 10 preferably includes a power actuator mechanism for pivoting the brush 20 relative to the brush arm 132. In the illustrated cleaner 10, a pneumatic piston and cylinder combination 168—the brush cylinder—is connected between the brush 20 and the brush arm 132 for pivoting the brush 20 relative to the brush arm 132. In particular, gusseted to the bottom surface of the brush arm 132 at its distal end (opposite the brush shaft 138) by gussets 170*a* is a brush cylinder support 170. The cylinder support 170 is generally C-shaped and extends downwardly from the bottom surface of the brush arm 132 (see FIGS. 10 and 12). The cylinder end of the brush cylinder 168 is connected to the support 170 and the rod end of the cylinder 168 is connected to the bottom surface of the bushing box 142. When the cylinder 168 is fully extended the brush 20 is pivoted upwardly relative to the brush arm 132 so that the brush 20 does not contact the surface of the ingots I in the molds M as they move along the conveyor C. As the cylinder 168 retracts, the brush 20 pivots downwardly toward the surface of the ingots I until the wirework 20*b* of the brush 20 contacts the surface of the ingots I. When the cylinder 168 is fully retracted, the spool 20*a* of the brush 20 will be just above the surface of the ingots I. It is within the ambit of the present invention to utilize various alternative power actuator mechanisms for pivoting the brush 20 relative to the brush arm 132.

The pneumatic brush cylinder 168 is connected to the common source of pressurized air 122. The cleaner 10 is designed to pivot the brush 20 relative to the brush arm 132 to maintain a substantially constant pressure—a "float" pressure—on the surface of ingot-filled-molds F. Such operation is provided by the portion of the circuit 124 that includes a lever valve 172 and a brush circuit regulator 174 (see FIG. 14). The lever valve 172 communicates with the source 122 through two separate lines, a regulated line 176 and an unregulated line 178. The lever valve 172 selectively directs pressurized air from one of the lines 176,178 to the cylinder end of the brush cylinder 168.

In operation, the lever valve 172 is manually set to direct pressurized air to the cylinder 168 from the regulated line 176. Pressurized air from the source 122 passes through the regulator 174, through the valve 172 and into the cylinder end of the cylinder 168. The regulator 174 is preset to the "float" pressure wherein the brush cylinder 168 pivots the brush 20 to provide and maintain a constant and consistent pressure on the surface of the ingot-filled-mold F. The "float" pressure is such that the wirework 20*b* of the brush 20 does not scratch the surface of the ingot I and does not substantially deform on the surface (e.g., bend or prematurely wear). As the brush 20 rotates over multiple ingots I, the wirework 20*b* will naturally (i.e., not prematurely) wear away. As this wear occurs, less of the weight of the brush 20 is supported on the surface of the ingot I; therefore, the brush cylinder 168 retracts until the brush 20 pivots and the equilibrium "float" pressure is achieved. As the cylinder 168 retracts, pressurized air is vented out of the rod end of the cylinder 168. The regulator 174 is preferably a fine precision regulator (e.g., one to one-and-a-half psi of back bleed).

For the cylinder 168 to maintain this desired constant and consistent "float" pressure, a counterbalance mechanism is preferred. In the illustrated cleaner 10 this mechanism includes a pair of springs 180. Fixed to the bottom edge of the brush arm 132 (adjacent the cylinder support 170 and opposite the triangular support members 140*c* of the support 140) are triangular shaped spring supports 182. The springs 180 are stretched between pins 184,186 supported on the support members 140*c* and the spring supports 180, respectively. The tension in the springs 180 provides a counterbalance for the brush cylinder 168. It is believed that this counterbalance provides a regulated and consistent float pressure as the brush cylinder 168 retracts.

The lever valve 172 can be manually set to direct pressurized air from the source 122 to the cylinder end of the cylinder 168 through the unregulated line 178. This is a manual override (e.g., for changing out or maintenance on the brush 20) that pressurizes the cylinder 168 causing it to fully extend thereby pivoting the brush 20 upwardly from the surface of the ingot-filled-mold F.

The cleaner 10 preferably includes a centralized lubrication system (not shown) to provide lubricating fluid to the friction-wear components (e.g., cylinders 112,120,168, bearings 50,52,82,84, support 140, and bushing box 142). The system includes lubrication lines (not shown) fluidly communicating with each of the wear components and a centralized lubrication station (not shown) (e.g., located on the base 12). The wear components can be manually lubricated (e.g., with a grease gun) from a centralized location without the need to maneuver in and around the cleaner 10 and its moving components.

OPERATION

The ingots I in the molds M move along the conveyor C in a left-to-right direction of travel relative to the cleaner 10 (when viewed as shown in FIG. 4). The ingot-filled-molds F are positioned every six inches on the conveyor C and the conveyor C moves at a speed of six feet per minute; therefore, approximately twelve ingot-filled-molds F will pass under the cleaner 10 per minute. It will be appreciated that the line speed of the conveyor C can be varied and the blade 18 and the brush 20 of the cleaner 10 can accommodate line speeds of thirty to thirty-two ingot-filled-molds F per minute. As a practical matter, the ingots I cannot sufficiently cool (i.e., harden) to enable the surface to be cleaned off at line speeds in excess of thirty-two ingot-filled-molds F per minute.

As an ingot-filled-mold F approaches the cleaner 10, the presence of the ingot-filled-mold F activates the limit switch 128—the blade 18 is in the before-cut position and the arm 16 is in the recoil position. The limit switch 128 energizes the sequencing circuit 124 and pressurized air flows through the valve 126 causing the lift cylinder 120 and the stroke cylinder 112 to fill with pressurized air. Extension of the lift cylinder 120 pivots the arm 16 into the cutting position, as shown in FIG. 5. The valve 172 is preset to either the down-pressure or the float-pressure (corresponding to the cutting application). The lift cylinder 120 fills with pressurized air before the stroke cylinder 112 is filled. In this manner, the stroke cylinder 112 remains substantially retracted—corresponding to the blade 18 being in the before-cut position—when the lift cylinder 120 is extended (see FIG. 5). With the circuit in this stage, the cutting edge 18*a* of the blade 18 contacts the surface of the ingot-filled-mold F at its proximal end.

Once the lift cylinder 120 reaches the cutting position, the stroke cylinder 112 is sufficiently pressurized to cause the cylinder to extend. As the stroke cylinder 112 extends, the blade assembly 104 slides along the tracks 100,102 corresponding to the cutting blade 18 sliding from the before-cut position toward the after-cut position. As the blade 18 slides, the cutting edge 18*a* is in contact with the surface of the ingot-filled-mold F and cuts dross off of the surface. In the after-cut position, the blade 18 is at or just past the distal end of the ingot-filled-mold F (see FIG. 6). As the blade 18 slides toward the after-cut position, the stroke cylinder 112 pivots about stub shafts 114*a*,114*b* (see FIGS. 5 and 6). The notch 90*a* in the arm end plate 90 provides the blade 18 adequate clearance when it is in the after-cut position. A collection bin (not shown) can be positioned adjacent the conveyor C to collect the dross that is pushed off of the surface. It will be appreciated that dross can account for as much as two or three percent of the total weight molded and typical molding operations can mold several hundred tons per day.

Once the stroke cylinder 112 if fully extended, corresponding with the blade 18 being in the after-cut position as shown in FIG. 6, the limit switch 128 activates the valve 126 causing the lift cylinder 120 and the stroke cylinder 112 to depressurize. Again, the lift cylinder 120 completely depressurizes before the larger stroke cylinder 112 completes depressurization. Depressurization of the lift cylinder 120 pivots the arm 16 into the recoil position as shown in FIG. 7. The notch 62*a* in the end plate 62 of the boom 14 and the notch 90*a* in the arm end plate 90 cooperate to provide the blade 18 adequate clearance when it is in the after-cut position and the arm 16 is in the recoil position (see FIG. 7). Once the lift cylinder 120 is retracted, the stroke cylinder 112 is sufficiently depressurized to cause the cylinder to retract. As the stroke cylinder 112 retracts, the blade 18 returns to the before-cut position. As the stroke cylinder 112 is retracting and the arm 16 is in the recoil position, the cutting edge 18*a* of the blade 18 is above the surface, and not in contact with the surface of the ingot-filled-mold F. In this manner, unlike prior art knives, the blade 18 does not drag back across the cut surface of the ingot-filled-mold F and thus does not pull cut dross back toward the cleaner 10.

The cycle time for the blade 18 moving from the before-cut position to the after-cut position and back to the before-cut position is approximately two seconds. The lift cylinder 120 and the stroke cylinder 112 are extending and retracting at least partially simultaneously. As previously discussed, alternative circuits, cylinders and pressure sources can be utilized. However, it is important that the arm 16 be in the cutting position before any substantial movement of the blade 18 from the before-cut position toward the after-cut position. If hydraulic cylinders are utilized it may be desirable to utilize a delay mechanism in the circuit in order to achieve the desired sequencing.

In some situations, the blade 18 will come into contact with an obstruction—an object on the surface of the ingot-filled-mold F that is substantially less pliable than the typical dross—for example, a protruding bolt head of a mold M. In this situation, the blade 18 will commonly catch and be prevented from continuing to slide toward the after-cut position; however, the ingot-filled-mold F continues to move along the conveyor C. In prior art blades, this was problematic. The continued movement of the ingot-filled-mold would cause the piston shaft to bend or even break resulting in necessary maintenance and downtime. In the cleaner 10, the pivoting of the arm 16, the pivoting of the stroke cylinder 112, and the pivoting of the boom 14 cooperate to provide a trunnion mounted blade 18 that reduces or prevents bending and breaking of the cylinder shaft if the blade 18 catches and is pulled along the conveyor C. In particular, the horizontal bearing wheel 110 is caused to act against the track edge 102*a* thereby causing the boom 14 to pivot on the boom shaft 46 out of the operating position toward the mold-clearing position. The stroke cylinder 112 continues to act against the blade assembly 104 (with pressure relief provided in a commonly known manner) and thus the blade 18 continues to act against the obstruction as the boom 14 pivots. Once the boom 14 has reached the mold-clearing position, the blade 18 clears the obstruction and completes the cycle until it returns to the before-cut position.

The boom 14 is yieldingly biased toward the operating position; therefore, once the blade 18 clears the obstruction, the weight 74 on the cable 76 pulls the boom 14 back toward the operating position until the boom 14 rests against the stop 78. The bottom surface of the proximal end of the bottom support plate 54 of the boom 14 slides along the nylon pad 44 as the boom 14 pivots between the operating and mold-clearing positions. Pressure is relieved from the boom shaft 46 thereby reducing incidents of bending or breaking of the shaft 46. In addition, the blade 18 is not in contact with the surface of the ingot-filled-mold as the blade 18 returns to the before-cut position; therefore, incidents of the blade 18 catching on an obstruction as it recoils are virtually eliminated.

After the ingot-filled-mold F has been cut by the blade 18, it moves along the conveyor C until it passes under the brush 20. The brush 20 rotates in a counterclockwise direction (when viewed as in FIG. 12) at a speed sufficient to rotate the brush 20 approximately two to three revolutions per ingot-filled-mold F. If the speed of the conveyor C is changed, the speed of the brush 20 is also preferably adjusted. The pressure in the brush cylinder 168, as controlled by the circuit 124, is preset so that the wirework 20*b* applies the desired pressure against the surface of the ingot-filled-mold F (i.e., the wirework 20*b* does not deform, nor does it scratch the surface of ingot I).

As the brush 20 rotates on the surface of the ingot-filled-mold F, remaining, loosened dross is "walked" out to the distal end of the brush 20 until the dross clears the distal end of the ingot-filled-mold F and falls off of the surface where it can be collected in a collection bin (not shown). Over time, the wirework 20*b* will wear down causing less of the weight of the brush 20 to be supported on the surface of the ingot-filled-molds F (and more of the weight supported by the cylinder 168). The regulator 174 of the circuit 124 controls the valve 172 to depressurize the brush cylinder 168 until the preset equilibrium is achieved, thereby causing the cylinder 168 to retract. As the cylinder 168 retracts, the brush 20 pivots on the brush shaft 138 thereby maintaining the desired pressure on the surface of the ingot-filled-molds F. When the cylinder 168 is completely retracted, the wirework 20*b* is completely worn down to the spool 20*a*; however, the cleaner 10 is configured so that the spool 20 does not contact the surface of the ingot-filled-molds F.

The preferred form of the invention described above is to be used as illustration only, and should not be utilized in a limiting sense in interpreting the scope of the present invention. Obvious modifications to the exemplary embodiment, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A cleaning apparatus for cleaning dross off of the surface of ingot-filled-molds moving along a conveyor, the cleaner comprising:

a base;

a boom pivotally mounted to the base and operable to pivot in a plane generally parallel to the surface of the ingot-filled-molds; and a cutting blade positioned in the plane generally parallel to the surface of the ingot-filled-molds and slidably supported on the boom in said plane, said cutting blade operable to longitudinally cut dross off of the surface of ingot-filled-molds as the ingot-filled-molds move along the conveyor.

2. The cleaner as claimed in claim 1, said boom being pivotable between an operating position, wherein the boom is substantially transverse to the conveyor, and a mold-clearing position, wherein the distal end of the boom has traveled along the conveyor in the direction of conveyor movement.

3. The cleaner as claimed in claim 2, said boom being yieldably biased toward the operating position.

4. The cleaner as claimed in claim 3 further comprising:

an arm pivotally supported on the boom, said blade being slidably supported on the arm, said arm being operable to pivot between a cutting position, wherein the blade is in contact with the surface of an ingot-filled-mold, and a recoil position, wherein the blade is clear of the surface of the ingot-filled-mold, said blade being operable to cut dross off of the surface of ingot-filled-molds when the arm is in the cutting position.

5. A cleaning apparatus for cleaning dross off of the surface of ingot-filled-molds moving along a conveyor, the cleaner comprising:

a base;

a boom pivotally mounted to the base and operable to pivot in a plane generally parallel to the surface of the ingot-filled-molds, said boom being pivotable between an operating position, wherein the boom is substantially transverse to the conveyor, and a mold-clearing position, wherein the distal end of the boom has traveled along the conveyor in the direction of conveyor movement, said boom being yieldably biased toward the operating position;

a cutting blade slidably supported on the boom, and operable to cut dross off of the surface of ingot-filled-molds as the ingot-filled-molds move along the conveyor;

an arm pivotally supported on the boom, said blade being slidably supported on the arm, said arm being operable to pivot between a cutting position, wherein the blade is in contact with the surface of an ingot-filled-mold, and a recoil position, wherein the blade is clear of the surface of the ingot-filled-mold, said blade being operable to cut dross off of the surface of ingot-filled-molds when the arm is in the cutting position; and a power actuator pivotally supported on the arm and operable to slide the blade fore and aft in a linear direction, said actuator pivotable about a center axis generally transverse to said linear direction.

6. A cleaning apparatus for cleaning dross off of the surface of ingot-filled-molds moving along a conveyor, the cleaner comprising:

a base;

a boom pivotally mounted to the base and operable to pivot in a plane generally parallel to the surface of the ingot-filled-molds, said boom being pivotable between an operating position, wherein the boom is substantially transverse to the conveyor, and a mold-clearing position, wherein the distal end of the boom has traveled along the conveyor in the direction of conveyor movement, said boom being yieldably biased toward the operating position;

a cutting blade slidably supported on the boom, and operable to cut dross off of the surface of ingot-filled-molds as the ingot-filled-molds move along the conveyor;

an arm pivotally supported on the boom, said blade being slidably supported on the arm, said arm being operable to pivot between a cutting position, wherein the blade is in contact with the surface of an ingot-filled-mold, and a recoil position, wherein the blade is clear of the surface of the ingot-filled-mold, said blade being operable to cut dross off of the surface of ingot-filled-molds when the arm is in the cutting position;

a power actuator pivotally supported on the arm and operable to slide the blade fore and aft in a linear direction, said actuator pivotable about a center axis generally transverse to said linear direction; and a rotatable brush pivotally supported on the base and operable to brush dross off of the surface of ingot-filled-molds, said brush being operable to maintain a substantially constant pressure on the surface of ingot-filled-molds.

7. A cleaning apparatus for cleaning dross off of the surface of ingot-filled-molds moving along a conveyor, the cleaner comprising:

a base;

an arm pivotally supported relative to the base; and a cutting blade slidably supported on the arm, said arm being operable to pivot generally transverse to a plane generally parallel to the surface of ingot-filled-molds, said arm being operable to pivot between a cutting position, wherein the blade is in contact with the surface of an ingot-filled-mold, and a recoil position, wherein the blade is clear of the surface of the ingot-filled-mold, said blade being operable to cut dross off of the surface of ingot-filled-molds when the arm is in the cutting position.

8. A cleaner as claimed in claim 7 further comprising:

a power actuator coupled between the arm and the base and operable to pivot the arm between the cutting position and the recoil position.

9. A cleaner as claimed in claim 8, said power actuator being a piston and cylinder unit.

10. A cleaner as claimed in claim 8, said arm including a bearing-receiving track operable to receive a blade-supporting bearing assembly, said blade including a blade-supporting bearing assembly operable to be received in the bearing-receiving track, said blade-supporting bearing assembly being operable to substantially support the weight of the blade vertically as the blade slides relative to the arm.

11. A cleaner as claimed in claim 10 further comprising:

a boom pivotally mounted to the base and operable to pivot in a plane generally parallel to the surface of the ingot-filled-molds, said arm being pivotally supported on the boom, said blade-supporting bearing assembly being operable to substantially support the weight of the blade horizontally as the boom pivots in the plane generally parallel to the surface of the ingot-filled-molds.

12. A cleaner as claimed in claim 11 further comprising:

a power actuator pivotally supported on the arm and operable to slide the blade fore and aft in a linear direction, said actuator pivotable about a center axis generally transverse to said linear direction.

13. A cleaner as claimed in claim 12 further comprising:

a rotatable brush pivotally supported on the base and operable to brush dross off of the surface of ingot-filled-molds, said brush being operable to maintain a substantially constant pressure on the surface of ingot-filled-molds.

14. A cleaning apparatus for cleaning dross off of the surface of ingot-filled-molds moving along a conveyor, the cleaner comprising:

a base;

a cutting blade slidably supported relative to the base and operable to cut dross off of the surface of ingot-filled-molds; and a power actuator pivotally supported relative to the base and operable to slide the blade fore and aft in a linear direction, said actuator pivotable about a center axis generally transverse to said linear direction.

15. A cleaner as claimed in claim 14, said power actuator being operable to slide the blade relative to the base between a before-cut position, wherein the blade is adjacent the proximal end of an ingot-filled-mold, and an after-cut position, wherein the blade is adjacent the distal end of the ingot-filled-mold.

16. A cleaner as claimed in claim 15, said power actuator being a piston and cylinder assembly.

17. A cleaner as claimed in claim 15 further comprising:

a boom pivotally mounted to the base and operable to pivot in a plane generally parallel to the surface of the ingot-filled-molds, said power actuator and said blade being supported on the boom.

18. A cleaner as claimed in claim 17 further comprising:

an arm pivotally supported on the boom, said blade being slidably supported on the arm, said arm being operable to pivot between a cutting position, wherein the blade is in contact with the surface of an ingot-filled-mold, and a recoil position, wherein the blade is clear of the surface of the ingot-filled-mold, said blade being operable to cut dross off of the surface of ingot-filled-molds when the arm is in the cutting position.

19. A cleaner as claimed in claim 18 further comprising:

a rotatable brush pivotally supported on the base and operable to brush dross off of the surface of ingot-filled-molds, said brush being operable to maintain a substantially constant pressure on the surface of ingot-filled-molds.

20. A cleaning apparatus for cleaning dross off of the surface of ingot-filled-molds moving along a conveyor, the cleaner comprising:

a base;

a rotatable brush pivotally supported relative to the base and operable to brush dross off of the surface of ingot-filled-molds, said brush being operable to maintain a substantially constant pressure on the surface of ingot-filled-molds; and a power actuator coupled between the brush and the base and operable to pivot the brush relative to the base to maintain said substantially constant pressure on the surface of ingot-filled-molds.

21. A cleaner as claimed in claim 20, said power actuator being a piston and cylinder combination.

22. A cleaner as claimed in claim 20, said brush being rotatable in a direction opposite the direction of movement of the conveyor.

23. A cleaner as claimed in claim 22, said brush at least partially extending beyond the distal end of the ingot-filled-molds.

24. A cleaning apparatus for cleaning dross off of the surface of ingot-filled-molds moving along a conveyor, the cleaner comprising:

a base;

a boom pivotally mounted to the base and operable to pivot in a plane generally parallel to the surface of the ingot-filled-molds;

an arm pivotally supported on the boom;

a cutting blade slidably supported on the arm, said arm being operable to pivot between a cutting position, wherein the blade is in contact with the surface of an ingot-filled-mold, and a recoil position, wherein the blade is clear of the surface of the ingot-filled-mold, said blade being operable to cut dross off of the surface of ingot-filled-molds when the arm is in the cutting position;

a brush arm rigidly fixed to the base; and a rotatable brush pivotally supported on the brush arm and operable to brush dross off of the surface of the ingot-filled-molds, said brush being operable to maintain a substantially constant pressure on the surface of the ingot-filled-molds.

25. A cleaner as claimed in claim 24 further comprising:

a first power actuator pivotally supported on the arm and operable to slide the blade in a generally linear direction relative to the arm between a before-cut position, wherein the blade is adjacent the proximal end of an ingot-filled-mold, and an after-cut position, wherein the blade is adjacent the distal end of the ingot-filled-mold, said actuator pivotable about a center axis generally transverse to said linear direction.

26. A cleaner as claimed in claim 25, said boom being pivotable between an operating position, wherein the boom is substantially transverse to the conveyor, and a mold-clearing position, wherein the distal end of the boom has traveled along the conveyor in the direction of conveyor movement, said boom being yieldably biased toward the operating position.

27. A cleaner as claimed in claim 26 further comprising:

a second power actuator coupled between the arm and the boom and operable to pivot the arm relative to the boom between a cutting position, wherein the blade is in contact with the surface of an ingot-filled-mold, and a recoil position, wherein the blade is clear of the surface of the ingot-filled-mold, said blade being operable to cut dross off of the surface of ingot-filled-molds when the arm is in the cutting position.

28. A cleaner as claimed in claim 27 further comprising:

a third power actuator coupled between the brush and the brush arm and operable to pivot the brush relative to the brush arm to maintain said substantially constant pressure on the surface of the ingot-filled-molds.

29. A cleaner as claimed in claim 28 further comprising:

a circuit connecting the first power actuator and the second power actuator to a common pressurized source, said circuit controlling pressure to the first and second actuators so that the arm is in the cutting position before the blade substantially slides from the before-cut position toward the after-cut position.

30. The cleaner as claimed in claim 29, said circuit controlling pressure to the first and second actuators so that the arm is in the recoil position before the blade substantially slides away from the after-cut position toward the before-cut position.

31. The cleaner as claimed in claim 30, said circuit being operable to adjustably control pressure to the second power actuator when the arm is in the cutting position between a down-pressure and a float-pressure, said down-pressure being variable and operable to effect a greater vertical force on the blade, relative to the float-pressure, as the blade slides from the before-cut position toward the after-cut position.

32. The cleaner as claimed in claim 31, said brush being positioned relative to the blade so that ingot-filled-molds moving along the conveyor pass under the blade before they pass under the brush.

33. A cleaning apparatus for cleaning dross off of the surface of ingot-filled-molds moving along a conveyor, the cleaner comprising:

a base;

a cutting blade slidably supported relative to the base and operable to cut dross off of the surface of ingot-filled-molds; and a power actuator pivotally supported relative to the base and operable to slide the blade fore and aft in a linear direction, said actuator pivotable about an axis generally transverse to said linear direction.

* * * * *